US006670037B1

(12) United States Patent
Okura et al.

(10) Patent No.: US 6,670,037 B1
(45) Date of Patent: Dec. 30, 2003

(54) INKJET-PRINTING MATERIALS AND COATING AGENTS THEREFOR

(75) Inventors: Kousuke Okura, Hiratsuka (JP); Toshihiro Kodera, Yokohama (JP); Hidemasa Mouri, Yokohama (JP)

(73) Assignee: Taiho Industries Co., Ltd., Tokyo (JP)

( * ) Notice: Subject to any disclaimer, the term of this patent is extended or adjusted under 35 U.S.C. 154(b) by 0 days.

(21) Appl. No.: 09/489,030

(22) Filed: Jan. 21, 2000

(30) Foreign Application Priority Data

Jan. 22, 1999 (JP) ..... H11-014638

(51) Int. Cl.[7] ..... B41M 5/00

(52) U.S. Cl. ..... 428/402; 106/31.01; 106/499; 428/32.34

(58) Field of Search ..... 428/195, 32.34, 428/402; 106/428, 31.01, 499

(56) References Cited

U.S. PATENT DOCUMENTS 4,649,064 A * 3/1987 Jones ..... 428/195
4,740,420 A * 4/1988 Akutsu et al. ..... 428/341
5,985,425 A * 11/1999 Tomizawa et al. ..... 428/212
6,071,623 A * 6/2000 Suguwara et al. ..... 428/428
6,110,601 A * 8/2000 Shaw-Klein et al. ..... 428/522
6,132,878 A * 10/2000 Kojima et al. ..... 428/411.1
6,197,101 B1 * 3/2001 Matsumura et al. ... 106/287.11
6,284,819 B1 * 9/2001 Darsillo et al. ..... 524/22
6,338,891 B1 * 1/2002 Kawasaki et al. ..... 428/195

OTHER PUBLICATIONS

High Purity Dispersible Aluminas: Disperal/Dispal (Product Bulletin of Condea Co.), obtained from website (www.condea.com) visted 12/01.*

* cited by examiner

*Primary Examiner*—B. Hamilton Hess
(74) *Attorney, Agent, or Firm*—Browdy and Neimark, P.L.L.C.

(57) ABSTRACT

A coating agent for a base for ink-jet printing comprises an alumina dispersion containing dispersed alumina and aluminium nitrate dissolved in an aqueous dispersing medium, and a binder. This coating agent and the coated base material are free of irritating odor, contain alumina well dispersed therein, and provide printed images on the inkjet-printing materials, which images are excellent in the color density, resistance to water, resistance to light and color definition.

18 Claims, No Drawings

INKJET-PRINTING MATERIALS AND COATING AGENTS THEREFOR

BACKGROUND OF THE INVENTION

1. Field of the Invention

The present invention relates to inkjet-printing materials as recording mediums and coating agents therefor, more particularly a coating agent for inkjet-printing materials providing excellent reproducibility of colors and capable of forming thereon a definite, i.e., clearly defined and certain, image having a high resistance to weathering including a high resistance to water and light, and which is free of an irritating odor due to acetic acid. The present invention also relates to the inkjet-printed material made by using the coating agent and also free of the irritating odor.

2. Description of Related Art

Hitherto, as a base material for image-printing materials, there have been employed, for example, various materials made from papers, plastic, metals, glasses, ceramics, leathers and woods. Furthermore, these printed base materials are of various forms, i.e., may be various films, sheets, flat plates, articles having a curved surface or irregular surface, woven fabrics, non-woven fabrics and foams.

As inkjet-printing base materials used in an inkjet printer there have been generally employed materials having ink-receptive layers formed on the opposite sides thereof by applying thereto a treating agent containing a cationic polymer. The cationic polymer-containing treating agent should be capable of rapidly absorbing the water content of aqueous inks and firmly fixing printed inks on printing base materials, thus preventing the printing base materials treated with the treating agent from being stained with ink just after printing.

Nevertheless, however, the above-mentioned treating agent in the ink-receptive layer applied on the inkjet-printing base materials is highly soluble in water. Therefore, with the above-mentioned treating agent there is such a problem that the printed base materials become stained with ink when the images printed on the ink-receptive layers are brought into contact with water.

In order to solve this problem, some proposals have been made, i.e., it has been proposed that a porous material be added to the cationic polymer-containing treating agent applied to the printing base material forming the ink-receptive layer (see JP Patent Unexamined Application Nos. S60-245588A, H7-2430B and H3-275378A). Of these, JP S60-245588A discloses an inkjet-printing base material having at least one ink-receptive layer formed thereon, said ink-receptive layer containing a porous alumina xerogel having pores of 40 to 1,000 Å in radius. JP Patent Unexamined Application No. H7-2430B discloses a recording sheet comprising a transparent base having a porous ink-receptive layer formed thereon, said ink-receptive layer being mainly comprised of pseudo-boehmite and containing pores of 100 to 1,000 Å in radius, and the total volume of the pores in the layer being 0.1 cc/g or less.

The printing materials provided with the porous material-containing ink-receptive layers can absorb the water and solvent contents of the ink into the specified pores of the porous material. Thus, the printed materials can be prevented from being stained with the ink, thereby improving the quality, such as a color density and coloring property, of images.

However, with the printing materials provided with porous material-containing ink-receptive layers problems have often occurred due to the poor dispersibility of the porous material. That is, a coating liquid comprising the porous material and an adhesive is easily gelled, hard to apply uniformly onto the base of the printing material, the applied ink-receptive layers are easily cracked when dried, or eventually printed materials are easily stained with ink, not providing any definite images.

In order to solve these problems, JP Patent Unexamined Application No. H4-67985A proposes a coating agent comprising an alumina sol containing a monocarboxylic acid such as acetic acid and a water-soluble polymer binder added thereto, and a printing sheet comprising a polyethyleneterephthalate(PET) film having the coating agent applied thereon. However, the coating agent mentioned above has a problem of the monocarboxylic acid emitting an irritating odor. Furthermore, the printing sheet also has the same problem of emitting the irritating odor, which is uncomfortable and unpleasant to users.

In addition, JP Patent No. 2714350 proposes a printing base material provided thereon with an ink-receptive layer by a dispersion of an alumina hydrate containing 0.1 to 1.0 wt % of a nitrate group and having a pore radius distribution having maximal values within less than 100 Å and between 100 Å and 200 Å. However, the nitrate group contained in the dispersion mentioned above is only an impurity of the alumina hydrate. Therefore, use of the dispersion mentioned above does not solve the problem of the printing material provided with the porous material-containing ink-receptive layer.

SUMMARY OF THE INVENTION

One object of the present invention is to provide a coating agent for producing an inkjet-printing material free of an irritating odor, which coating agent is good in dispersing alumina and applied to a base such as paper and plastic films.

Another object of the present invention is to provide an inkjet-printing material which is free of an irritating odor and good in reproducibility of colors, has a high resistance to water and weathering, and provides definite images thereon.

DETAILED DESCRIPTION OF PREFERRED EMBODIMENTS OF THE INVENTION

In accordance with the present invention, the coating agent is an alumina dispersion comprising alumina dispersed in an aqueous dispersing medium, aluminium nitrate and a binder. The present invention is different from the invention disclosed in said JP Patent 2714350 on the point of view that the coating agent in the present invention contains not alumina hydrate but alumina and aluminium nitrate and ink-receptive layer contains not alumina but alumina hydrate and not contains aluminium nitrate.

In a preferred embodiment of the coating agent of the present invention, the alumina is substantially δ-alumina having an average primary particle size of 5 to 100 nm, the amount of aluminium nitrate added is within the range of 0.1 to 10 parts by weight based on 100 parts by weight of alumina, particularly δ-alumina.

In accordance with the present invention, an ink-receptive layer is provided on the base material by applying the coating agent mentioned above onto the base to thereby produce the inkjet-printing material.

I. COATING AGENT

The coating agent of the present invention is described below.

Each of the alumina dispersion and the binder used in the coating agent of the present invention is described below.

1-1 Alumina Dispersion

The alumina dispersion comprises an aqueous dispersing medium containing alumina dispersed therein, and aluminium nitrate.

(1) Alumina

The alumina may be anhydrous aluminum oxide or hydrous aluminum oxide.

The anhydrous aluminum oxide may be α-alumina, β-alumina, γ-alumina δ-alumina, θ-alumina or χ-alumina.

The hydrous aluminum oxide may be an alumina hydrate such as boehmite, pseudboemite, gibbsite, bayerite, norstrandite, diaspore, toedite, alumina gel, which may be called "aluminum hydroxide".

In the present invention, "aluminas" includes "anhydrous alumina" and "alumina hydrates", if not specified.

Of the aluminas, for example, an alumina is preferably made by a vapor phase process, i.e., by hydrolyzing a gaseous metal chloride in the presence of water produced in the oxygen-hydrogen reaction at the temperature specific to the oxygen-hydrogen reaction, more specifically δ-alumina.

One or more of the alumina may be used in the coating agent of the present invention.

The alumina is desirably used in a powder form. The alumina particles in powdery form have an average primary particle size of preferably 5 to 100 nm, particularly preferably 5 to 50 nm. When the average primary particle size is in this range, the dispersion of the alumina is much better. The average primary particle size may be determined by an electron microscope.

The amount of the alumina added to the alumina dispersion is normally at most 60 wt %, preferably 15 to 50 wt %. When the amount is within this range, the alumina is more effectively dispersed. If the amount does not exceed 60 wt %, there occurs no unpreferred thickening or gelling due to shorter distances between alumina particles. When the amount of the alumina in the coating agent is not more than 60 wt %, particularly within the range of 15 to 50 wt %, the viscosity of the alumina dispersion can easily be adjusted to preferably a range of 50 to 1,000 cps. Thus, the coating agent of the present invention is easy to handle.

(2) Aqueous Dispersing Medium

The aqueous dispersing medium for dispersing the alumina maybe, for example, water, methanol, ethanol, n-propyl alcohol, isopropyl alcohol, acetone, methylethyl ketone, ethyl acetate and/or glycols. A mixed medium comprising one or more of the aqueous dispersing mediums may be selected.

The mixed medium may be, for example, of water and isopropyl alcohol; water and methanol and/or ethanol; water, ethylene glycol and isopropyl alcohol; water, ethylene glycol, isopropyl alcohol and ethyl acetate.

(3) Aluminium Nitrate

A dispersant for the alumina dispersion may be aluminium nitrate. The aluminium nitrate is considered to assist the dispersion of alumina particles in the alumina dispersion and the coating agent of the present invention.

The aluminium nitrate may be, for example, aluminium nitrate nonahydrate, aluminium nitrate octahydrate, aluminium nitrate hexahydrate or aluminium nitrate tetrahydrate. Particularly, aluminium nitrate nonahydrate is preferred, because it is stabler than the others.

The amount of the aluminium nitrate added to the alumina dispersion is normally 0.1 to 10 parts by weight, preferably 0.5 to 5 parts by weight, based on 100 parts by weight of alumina in the alumina dispersion. If the amount is less than 0.1 part by weight based on 100 parts by weight of alumina, no adequate thickening effect and high resistance to weathering can be obtained, that is the object of the present invention cannot be achieved. On the other hand, if the amount exceeds 10 parts by weight based on 100 parts by weight of alumina, then the viscosity of the alumina dispersion is too high, and the dispersion may sometimes become gelled.

In the alumina dispersion, to the aluminium nitrate may be added at least one of the other metal nitrates, such as magnesium nitrate, calcium nitrate, nickel nitrate and zinc nitrate. When the metal nitrates are used together with the aluminium nitrate, the amount thereof is not more than 10 parts by weight, preferably within the range of 0.1 to 10 parts by weight based on 100 parts by weight of aluminium nitrate for the purpose of producing a stable alumina dispersion.

(4) Process for Producing Alumina Dispersion

The alumina dispersion can be produced by mixing aluminium nitrate, alumina and an aqueous dispersing medium. This mixing may be carried out by a supersonic dispersing machine, sand mill, static mixer or high pressure dispersing machine, to uniformly disperse alumina into the aqueous dispersing medium.

In the present invention, the pH of the alumina dispersion may be regulated or adjusted to a weakly acidic range, preferably pH 2 to pH 6, so that the dispersion may be more effectively made.

(5) Other Components in the Alumina Dispersion

In order to regulate the pH of the alumina dispersion, one or more of inorganic acids, organic acids and nitrogen-containing carboxylic acids may be added to the alumina dispersion.

As the inorganic acid, reference may be made in general to inorganic acids such as nitric acid.

As the organic acid, reference may be made to a dicarboxylic acid, aromatic carboxylic acid, hydroxycarboxylic acid or nitrogen-containing carboxylic acid.

The dicarboxylic acid may be oxalic acid, malonic acid, succinic acid, maleic acid or fumaric acid.

The aromatic carboxylic acid may be benzoic acid or toluyl acid.

The hydroxycarboxylic acid may be glycolic acid, lactic acid, tartaric acid, malic acid or citric acid.

The nitrogen-containing carboxylic acid may be a carboxylic acid containing at least one nitrogen atom in the molecule thereof, such as amino acid or nicotinic acid.

If acetic acid or formic acid is added to the alumina dispersion, then an irritating odor may be emitted during the step of the production of the coating agent, i.e., the step of mixing the alumina dispersion and the binder liquid mentioned below, and during the step of the production of the inkjet-printing material, i.e., the step of applying the coating agent to the printing base material. The obtained inkjet-printing material may also have an irritating odor derived from the acetic acid, etc. Therefore, acetic acid and formic acid should be used in as small an amount as possible, in the alumina dispersion, if they can or must be present in the it.

(6) Amount of Alumina Dispersion in the Coating Agent

The amount of the alumina dispersion in the coating agent is normally not less than 15 wt %, preferably 15 to 50 wt %. When the amount of the alumina dispersion is within the range above, the object of the present invention can be adequately achieved, and since an adequate thickness can be obtained by one application step, a single layer coating can achieve the ink-receptive layer required by the present invention. Therefore, the inkjet-printing material can be produced at low cost.

1-2 Binder

The binder to be added to the coating agent of the present invention may be an organic polymeric substance such as starch or, any of its modified products, polyvinyl alcohol or any of its modified products, a soluble polyamide soluble in a solvent such as an alcohol, hydroxycellulose, hydroxymethyl cellulose, carboxymethyl cellulose or polyvinyl pyrrolidone. Furthermore, at least one of SBR latex and NBR latex may be added as an adjuvant for improving the adhesion between the ink-receptive layer and the base.

Of the organic polymeric substances, polyvinyl alcohol and its modified products and soluble polyamide are preferred. Particularly, a mixture of polyvinyl alcohol with one of the modified products of polyvinyl alcohol, i.e., polyvinyl acetal, is preferred.

Polyvinyl acetal having a molecular weight of $10\times10^4$ to $20\times10^4$ and a degree of acetallization of 0.3 to 10 mol % is particularly preferred. If the molecular weight and degree of acetallization of the polyvinyl acetal are within the above-mentioned ranges, then the obtained coating agent is not gelled. Therefore, a high quality inkjet-printing material can easily be obtained by applying the coating agent to the base. The obtained ink-receptive layer has an adequate thickness and a high resistance to water. Thus, the images formed on the ink-receptive layer are highly definite and does not flow with water.

Of the polyvinyl alcohols mentioned above, one having a saponification value of 65 to 90 mol % is preferred. If the saponification value of the polyvinyl alcohol is within the above-mentioned range, then the obtained ink-receptive layer is good both in its resistance to water and ink-absorbing rate.

The binder, particularly polyvinyl alcohol and polyvinyl acetal may be used in an aqueous solution or an alcoholic solvent solution.

As the alcoholic solvent reference may be made to a lower aliphatic alcohol, glycol, or a mixed solvent of another solvent with the lower apliphatic alcohol.

The lower aliphatic alcohol may be, for example, methanol, ethanol, propanol, isopropyl alcohol, n-butyl alcohol, sec-butyl alcohol, tert-butyl alcohol, etc.

The glycol may be, for example, ethylene glycol, trimethylene glycol, tetramethylene glycol, pentamethylene glycol, 1,2-propanediol, 1,2-butanediol, 1,3-butanediol, 2,3-butanediol, 2-ethyl-1,3-hexanediol, etc.

As the mixed solvent mentioned above, reference may be made to mixtures of at least one solvent of water, benzyl alcohol, formic acid and acetic acid with the above-mentioned lower aliphatic alcohol. More specifically, the mixed solvent is a mixture of water and methanol.

The amount of the binder added to the coating agent of the present invention varies depending on the layer thickness required. It is normally 5/1 to 12/1 in terms of the alumina/binder (solid weight ratio), preferably 5/1 to 10/1.

If the amount of the binder is below the above-mentioned range, then the adhesion between the ink-receptive layer and the base is lowered to an extent that it cannot be practically used.

On the other hand, if the amount of the binder is beyond the range mentioned above, then the obtained inkjet-printing material may have so poor an ink-absorbing power that the ink-fixing power is lowered.

1-3 Other Additives

To the coating agent of the present invention may be further added a leveling agent.

This leveling agent may be, for example, a water-soluble modified silicone oil and a water-soluble fluorine-containing surface active agent.

The water-soluble modified silicone oil may be, for example, an alcohol-modified silicone oil and an ether-modified silicone oil.

The water-soluble fluorine-containing surface active agent may be, for example, a perfluoroalkyl sulfonate, perfluoroalkyl carboxylate and perfluoroalkyl betaine.

To the coating agent of the present invention may be added such amounts of some further additives that they are not a bar against the objects of the present invention. These additives may be a pH-regulating agent, viscosity-regulating agent, antifoaming agent, defoaming agent, dispersion-stabilizing agent, brightening agent and releasing agent, etc.

1-4 Process for Preparing Coating Agent

The process for preparing the coating agent of the present invention is not specifically limited. The coating agent of the present invention may be prepared by, for example, firstly preparing both the above-mentioned alumina dispersion and a binder liquid containing the above-mentioned binder dissolved or dispersed in water or the above-mentioned alcoholic solvent and then mixing the alumina dispersion and the binder liquid; firstly preparing the alumina dispersion and then dissolving or dispersing a binder in the alumina dispersion; or mixing together all the alumina, aluminium nitrate and aqueous dispersing medium, which are the main ingredients of the alumina dispersion, the binder and, if necessary, the solvent for the binder.

In any of the processes mentioned above, a more uniform dispersion may be obtained by using an apparatus such as a supersonic dispersing machine, sand mill, static mixer or high pressure dispersing machine in any step of the process. For example, such an apparatus may be used in a step of mixing the alumina dispersion and the binder liquid; in a step of dissolving or dispersing the binder into the alumina dispersion; or mixing together all the ingredients, alumina, aluminium nitrate, aqueous dispersing medium, binder and dispersing medium.

The coating agent obtained by any of the processes mentioned above is preferably defoamed by a supersonic defoaming or vacuum defoaming treatment.

II. INKJET-PRINTING MATERIALS

The inkjet-printing material of the present invention comprises the ink-receptive layer formed from the coating agent mentioned above and the base supporting the ink-receptive layer.

In the inkjet-printing material of the present invention, the ink-receptive layer has the function of receiving an ink jetted from an inkjet printer to the inkjet-printing material to form an image on the material.

The thickness of the ink-receptive layer is not limited, but is normally 10 to 60 $\mu$m, practically preferably 20 to 50 $\mu$m.

The shape of the base is not specified. The base may be a film, sheet, flat plate, an article having a curved surface or irregular surface, a woven fabric, non-woven fabric or foam.

The base may be made from papers, fabrics, plastic films, foamed sheets, glass sheets, ceramic sheets, leather sheets, and metal sheets or foils. These base materials may be used singly or in combination, e.g., in a laminated form of two or more of these materials.

The papers above may be fine quality papers, handmade papers, Japanese paper and printing papers.

The fabrics above may be woven fabrics and non-woven fabrics.

The plastic films above may be made of a polymer such as polyethylene terephthalate.

The foamed sheets above may be a foamed polystyrene sheet, foamed polyethylene sheet, and foamed polypropylene sheet.

The metal sheets or foils above may be a stainless sheet or foil, aluminum sheet or foil, iron sheet or foil, and steel sheet or foil.

In the present invention, the above-mentioned coating agent is coated on the base to form the ink-receptive layer.

The coating operation may be carried out by using any of a blade coater, reverse coater, die coater, comma coater, or air knife. In addition, the coating may be carried out by a gas-jetted aerosol spraying, or a manual pumping spraying, or further by brush coating, spatula coating or rod coating. The ink-receptive layer having an even thickness can be obtained on the base by any of the coating methods mentioned above.

The coating agent may be coated directly or via a primer on the base.

III. FUNCTION OF THE INVENTION

In the coating agent of the present invention, the alumina dispersion contains aluminium nitrate. This makes it possible to avoid the disadvantages, such as thickening of aqueous dispersing mediums, agglomeration and precipitation of alumina or gelling of the alumina dispersion, which are observed in the prior art alumina dispersions.

In the inkjet-printing materials, an ink component such as a dye is fixed on the alumina of the ink-receptive layer when printed. The coating agent of the present invention contains alumina uniformly dispersed therein. Therefore, the ink-receptive layer made from the coating agent also contains the alumina uniformly deposited therein. Accordingly, the ink component is not unevenly fixed in the ink-receptive layer of the inkjet-printing material according to the present invention.

In some inkjet-printing procedures, an anionic ink component contained in the inkjet-printing ink and the alumina contained in the ink-receptive layer of the inkjet-printing material of the present invention attract each other through an electrical force. This improves the ink-fixing effect.

According to the present invention, the particles of the alumina contained in the ink-receptive layer have an average primary particle size ranging from 5 to 100 nm. Therefore, the ink component is rapidly and evenly fixed in the ink-receptive layer. On the other hand, the water or organic solvent contained in the ink is rapidly and evenly diffused into the ink-receptive layer. Therefore, the inkjet-printing material of the present invention can provide a more rapid set which is dry to the touch, so that higher quality images can be obtained.

Using the inkjet-printing material of the present invention realizes images of a high image quality, clear color, high color density and high water resistance, and firmly fixed on the material.

EXAMPLES AND COMPARATIVE EXAMPLES

Evaluation of Properties

The properties of the alumina dipersions, coating agents and inkjet-printing materials prepared in the Examples and Comparative Examples illustrated below are determined and evaluated in the manners as mentioned below.

<Dispersibility>

The dispersibility of alumina in the alumina dispersion was evaluated by determining the viscosity of the dispersion with Rotor No. 2 in B-Viscometer made by Tokyo Keiki Seizosho, Kabushiki Kaisha at a revolution number of 60 rpm. The viscosity is expressed in cps unit. As the viscosity of the alumina dispersion is lower, the dispersibility of alumina is evaluated as being higher. As the viscosity is higher, the dispersibility is evaluated as being lower.

The dispersibility of alumina in the coating agent was also evaluated by determining the viscosity of the coating agent in same manner as used for the alumina dispersion. For the coating agent, the dispersibility are rated with the following symbol marks:

◎ when the viscosity was 600 cps or lower,

○ when the viscosity was higher than 600 cps but not higher than 1000 cps,

Δ when the viscosity was higher than 1000 cps but not higher than 2000 cps, and

X when the viscosity was higher than 2000 cps or when gelled.

<Color density>

Inkjet-printing materials were prepared by coating the coating agent on the polyethylene terephthalate film. Solid printing was made on the inkjet-printing materials with color inks of cyan (C), magenta (M), yellow (Y) and black (BK) through an inkjet printer, PM700C made by Seiko Epson Kabushiki Kaisha. The solid print was determined for the color density (OD value) of each of the color inks through Macbeth Portable Strength Meter RD-1255. The color density was evaluated as follows:

for cyan,

◎ when the OD value was higher than 1.8,

○ when the OD value was 1.8 to 1.6, and

X when the OD value was lower than 1.6;

for magenta,

◎ when the OD value was higher than 1.8,

○ when the OD value was 1.8 to 1.6, and

X when the OD value was lower than 1.6;

for yellow,

◎ when the OD value was higher than 1.6,

○ when the OD value was 1.6 to 1.4, and

X when the OD value was lower than 1.4; and for black,

◎ when the OD value was higher than 2.0,

○ when the OD value was 2.0 to 1.8, and

X when the OD value was lower than 1.8.

<Absorption of Ink>

Black solid print was made on the same inkjet-printing material as mentioned above with an ink of black+cyan+magenta+yellow through an inkjet printer, PM700C made by Seiko Epson Kabushiki Kaisha. The printed material was brought in contact with a PPC paper in 10 second after the solid printing. The absorption of ink of the inkjet-printing material was evaluated on whether the PPC(Plain Paper Copy) paper was stained or not, and rated in the following criteria:

◎ when no stain was found on the PPC paper,

○ when a small amount of stain was found on the PPC paper and

X when a clear stain was found on the PPC paper.

<Resistant to Water>

The same solid print as for the absorption of ink above was made on the inkjet-printing material. The printed material was dipped into flowing water for 5 minutes. The evaluation was made in the following criteria:

◎ when no ink diffusion was found,

○ when a small amount of diffusion was found, and

X when an amount of diffusion was found.

<Resistance to Light>

A inkjet-printing material was prepared by the same manner written in the column of evaluation of the color density above. Solid print was made on the inkjet-printing material in the same manner as mentioned in the evaluation of the color density above. The printed material was irradiated with an ultraviolet ray through a xenon long-life fade meter, FAL-25AXU made by Suga Sikenki Kabushiki Kaisha at a temperature of 60° C., humidity of 60% and illumination of 1.5 W/m$^2$ for 24 hours. Before and after the irradiation, the color density (OD value) of the printed material was determined through Macbeth Portable Strength Meter RD-1255. The evaluation was made in the following criteria:

◎ when the ratio of the OD value after irradiation to that before irradiation was higher than 90%, ○ when the ratio was from 90% to 80%, and X when the ratio was lower than 80%.

<Color Definition>

Highly fine color digital standard image data, ISO/JIS-SCID "portrait" (edited by Image-Processing Technology Standardization Committee; supervised and published by Japanese Standards Association) was printed on the inkjet-printing material through the above-mentioned inkjet printer. The printed material was observed with eyes. The evaluation was made in the following criteria:

◎ when the image was definite,

○ when the image was considerably definite,

Δ when the image was indefinite but so definite that one could understand what it was, and X when the image was so indefinite that one could not understand what it was.

<Odor>

Five(5) persons took a smell at non-printed inkjet-printing materials. The evaluation was made in the following criteria:

○ when three(3) or more of the five persons did not smell, and

X when three(3) or more of the five persons smelled.

<Preparation of Alumina Dispersion>

Referential Example 1 and Comparative Examples 1 and 2

Water was used as the aqueous dispersing medium, δ-alumina as the alumina, and any of aluminium nitrate nonahydrate and glacial acetic acid as the dispersant, or any dispersant was not used, to prepare an alumina dispersion. The presence and kind of the dispersant are shown in Table 1. The δ-alumina was made by Degussa Co., Ltd. and had an average primary particle size of 13 nm. Its trade name is A1203C. The amount of the δ-alumina in the alumina dispersion was changed within the range of 10 to 60 wt % based on the entirety of the dispersion, as shown in Table 1. The amount of the dispersant in the alumina dispersion was 1.5 wt %. The resultant alumina dispersions had a viscosity as shown in Table 1.

TABLE 1

| Content of δ-alumina (wt %) | Viscosity of alumina dispersion (cps) | | |
|---|---|---|---|
| | Referential Ex. | Comparative Ex. 1 | Comparative Ex. 2 |
| | Dispersant added | | Dispersant not added |
| | $Al(NO_3)_3.9H_2O$ | Acetic acid | |
| 10 | 2.00 | 5.00 | 0.25 |
| 20 | 4.50 | 7.00 | 20.00 |
| 30 | 20.00 | 50.00 | 710.00 |
| 40 | 32.50 | 80.00 | Gelled |
| 50 | 50.00 | 200.00 | Not dispersed |
| 60 | 100.00 | Not dispersed | Not dispersed |

As is clear from Table 1, the alumina dispersion of Referential Example using aluminium nitrate nonahydrate as the dispersant had a viscosity of 20 cps at a δ-alumina content of 30 wt %, 32.5 cps at 40 wt %, 50 cps at 50 wt % and only 100 cps even at a high content of 60 wt %.

To the contrary, the alumina dispersion of Comparative Example 1 using acetic acid as the dispersant had so high a viscosity as 200 cps even at a low alumina content of 50 wt %, and the δ-alumina was not dispersed at 60 wt %.

Moreover, the alumina dispersion of Comparative Example 2 not adding the dispersant had a viscosity of 20 cps at a δ-alumina content of 20 wt %, but so high a viscosity as 710 cps at 30 wt %, and gelled at 40 wt %.

From the foregoing it is clear that the aluminium nitrate nonahydrate has a function of well dispersing alumina in an aqueous medium, and that this function is much greater than that of acetic acid which has hitherto been used as the dispersant.

<Preparation of Coating Agent>

Example 1

One part by weight of aluminium nitrate nonahydrate was added to a mixture of 39 parts by weight of water and 25 parts by weight of isopropyl alcohol. To the resultant was added 35 parts by weight of δ-alumina, A1203C, made by Degussa Co., Ltd. and had an average primary particle size of 13 nm, to thereby prepare an alumina dispersion. The resulting alumina dispersion had a viscosity of 60 cps.

Then, 40 parts by weight of a water/isopropyl alcohol solution of a polyacetal resin (made by Sekisui Chemical Co., Ltd.; trade name: Esrek KX-1; molecular weight: $18\times10^4$; degree of acetalization: 8 mol %; and the amount of resin: 8 weight %) was mixed with 20 parts by weight of an aqueous solution of a polyvinyl alcohol resin (made by Kuraray Co., Ltd.; trade name: Kuraray Poval PVA420; degree of saponification: 78.0 to 81.0; resin content: 10 wt %), which was then stirred.

Then, 60 parts by weight of a mixture of the water/isopropyl alcohol solution of polyvinyl acetal resin with the aqueous solution of polyvinyl alcohol resin was added to 100 parts by weight of the alumina dispersion, to thereby prepare the coating agent. The resulting coating agent had a viscosity of 600 cps.

Then, the coating agent was coated on a base of a polyethylene terephthalate film to form an ink-receptive layer on the base, thereby making an inkjet-printing material. The polyethylene terephthalate film was made by Du Pont de Nemours, E.I. & Co. (trade name: Merinex339) and had a thickness of 100 μm. The coating agent above was coated with a film coater to form an ink-receptive layer on one side of the film, so that the resulting ink-receptive layer had a thickness of 32 μm when dried.

For the resulting inkjet-printing material, the absorption of ink and odor of the material, and the color density, resistance to water, resistance to light and color definition of printed images were determined. The results are shown in Table 2.

Example 2

An alumina dispersion and coating agent were prepared in the same manner as in Example 1, except that pseudoboehmite (made by Condea Vista Corporation; trade name: DISPAL ALUMINA POWDER 23N4-80; average primary particle size: 115 nm) was used The resulting coating agent had a viscosity of 600 cps. The alumina was well dispersed.

An inkjet-printing material was made by coating the resulting coating agent on a base of a polyester film in the same manner as in Example 1.

For the resulting inkjet-printing material, the absorption of ink and odor of the material, and the color density, resistance to water, resistance to light and color definition of printed images were determined in the same manner as in Example 1. The results are shown in Table 2.

Example 3

An alumina dispersion and coating agent were prepared in the same manner as in Example 1, except that the same δ-alumina as used in Example 1 and the same pseudoboehmite as used in Example 2 were mixed in a weight ratio of 8:2. The resulting coating agent had a viscosity of 600 cps. The alumina was well dispersed.

An inkjet-printing material was prepared in the same manner as in Example 1.

For the resulting inkjet-printing material, the absorption of ink and odor of the material, and the color density, resistance to water, resistance to light and color definition of printed images were determined in the same manner as in Example 1. The results are shown in Table 2.

Comparative Example 3

An alumina dispersion and coating agent were prepared in the same manner as in Example 1, except that acetic acid was used in an amount of 1.0 part by weight in place of using aluminium nitrate nonahydrate. The resulting coating agent had a viscosity of 600 cps. The alumina was well dispersed.

An inkjet-printing material was prepared in the same manner as in Example 1.

For the resulting inkjet-printing material, the absorption of ink and odor of the material, and the color density, resistance to water, resistance to light and color definition of printed images were determined in the same manner as in Example 1. The results are shown in Table 2.

Comparative Example 4

Example 1 was repeated, except that 1.0 part by weight of magnesium nitrate hexahydrate was substituted for the aluminium nitrate nonahydrate as the dispersant.

However, the alumina was gelled. Thus, no alumina dispersion could be prepared.

Accordingly, neither coating agent nor inkjet-printing material was also made.

Comparative Example 5

Example 1 was repeated, except that 1.0 part by weight of calcium nitrate tetrahydrate was substituted for the aluminium nitrate nonahydrate as the dispersant.

However, the alumina was gelled as in Comparative Example 4. Thus, no alumina dispersion could be prepared.

Accordingly, neither coating agent nor inkjet-printing material was also made.

Comparative Example 6

Example 1 was repeated, except that 1.0 part by weight of nickel nitrate hexahydrate was substituted for the aluminium nitrate nonahydrate as the dispersant.

However, the alumina was gelled as in Comparative Examples 4 and 5. Thus, no alumina dispersion could be prepared.

Accordingly, neither coating agent nor inkjet-printing material was also made.

Comparative Example 7

Example 1 was repeated, except that 1.0 part by weight of zinc nitrate hexahydrate was substituted for the aluminium nitrate nonahydrate as the dispersant.

However, the alumina was gelled as in Comparative Examples 4 to 6. Thus, no alumina dispersion could be prepared.

Accordingly, neither coating agent nor inkjet-printing material was also made.

TABLE 2

| | Examples | | | Comparative Examples | | | | |
|---|---|---|---|---|---|---|---|---|
| | 1 | 2 | 3 | 3 | 4 | 5 | 6 | 7 |
| Alumina | δ-alumina | Pseudo-boehmite | δ-alumina/ Pseudo-boehmite | δ-alumina | δ-alumina | δ-alumina | δ-alumina | δ-alumina |
| Dispersant | Aluminum nitrate | Aluminum nitrate | Aluminum nitrate | Acetic acid | Magnesium nitrate | Calcium nitrate | Nickel nitrate | Zinc nitrate |
| Items of evaluation | | | | | | | | |
| Dispersibility of alumina | ◎ | ◎ | ◎ | ◎ | X | X | X | X |
| Color strength | | | | | | | | |
| Y | ◎ | ◎ | ◎ | ◎ | — | — | — | — |
| M | ◎ | ◎ | ◎ | ○ | — | — | — | — |

TABLE 2-continued

| | Examples | | | Comparative Examples | | | | |
|---|---|---|---|---|---|---|---|---|
| | 1 | 2 | 3 | 3 | 4 | 5 | 6 | 7 |
| C | ◎ | ◎ | ◎ | ○ | — | — | — | — |
| BK | ◎ | ◎ | ◎ | ○ | — | — | — | — |
| Absorption of ink | ◎ | ◎ | ◎ | ○ | — | — | — | — |
| Resistance to water | ◎ | ◎ | ◎ | ○ | — | — | — | — |
| Resistance to light | | | | | | | | |
| Y | ◎ | ◎ | ◎ | ○ | — | — | — | — |
| M | ◎ | ◎ | ◎ | ○ | — | — | — | — |
| C | ◎ | ◎ | ◎ | ○ | — | — | — | — |
| BK | ◎ | ◎ | ◎ | ○ | — | — | — | — |
| Color Definition | ◎ | ◎ | ◎ | Δ | — | — | — | — |
| Odor | ○ | ○ | ○ | X | — | — | — | — |

In Table 2, "—" means that no evaluation was effected.

As shown in Table 2, the coating agent of Examples 1 to 3 had a viscosity of 600 cps or lower. Therefore, the coating agents of Examples 1 to 3 were excellent in the dispersibility of alumina.

Moreover, the inkjet-printing materials obtained in Examples 1 to 3 were color printed through an inkjet printer. Very high OD values were obtained for all the materials: higher than 1.8 for cyan, higher than 1.8 for magenta, higher than 1.6 for yellow, and higher than 2.0 for black. This means that the inkjet-printing materials of Examples 1 to 3 provided printed images having definite and bright colors of cyan, magenta, yellow and black.

Furthermore, no ink transferred from the inkjet-printing materials of Examples 1 to 3 to PPC papers brought into contact with the materials, even immediately after the materials were solid printed. From this it is clear that the inkjet-printing materials of Examples 1 to 3 have a high absorption of ink. Therefore, hands or other things are minimally stained or not stained at all with inks when they are brought into contact with the just printed inkjet-printing materials of the present invention.

Still further, the inkjet-printed materials of Examples 1 to 3 were dipped in a flowing water for 5 minutes. No ink diffusion or inks "running" was found. This means that images printed on the inkjet-printing materials of the present invention are highly resistant to water. Since inkjet-printers normally use aqueous inks, the inkjet-printing materials of the present invention are highly excellent from the practical view.

In addition, "portrait" images printed on the inkjet-printing materials of Examples 1 to 3 were highly definite. Thus, the inkjet-printing materials of the present invention are excellent in color definition.

Moreover, the inkjet-printing materials of Examples 1 to 3 had little amount of an offensive smell from acetic acid, which prior art materials always had. The five persons test panel did not smell acetic acid at all in the materials of these Examples.

To the contrary, the coating agent of Comparative Example 3 containing acetic acid as the dispersant was good in its dispersibility of alumina, but it was inferior in absorption of ink and the color density, resistance to water, resistance to light and color definition of printed images to the inkjet-printing materials of the present invention. Furthermore, the inkjet-printing material of Comparative Example 3 had a strong smell from acetic acid.

From Comparative Examples 4 to 7, it is clear that nitrates of magnesium, calcium, nickel and zinc are unsuitable as the dispersant for the coating agent for the inkjet-printing material.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . " or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same function can be used; and it is intended that such expressions be given their broadest interpretation.

What is claimed is:

1. A coating agent consisting of:

an alumina dispersion of alumina dispersed and aluminum nitrate dissolved in an aqueous dispersing medium, and a binder, wherein said alumina is δ-alumina or pseudboemite, wherein said alumina has an average primary particle size of 5 to 100 nm, wherein the amount of aluminum nitrate in the alumina dispersion is within the range of 0.1 to 10 parts by weight based on 100 parts by weight of said alumina, and wherein said aluminum nitrate is aluminum nitrate nonahydrate, and optionally further consisting of at least one of an acid, an alcoholic solvent, a leveling agent, a pH-regulating agent, a viscosity-regulating agent, an antifoaming agent, a defoaming agent, a dispersion-stabilizing agent, a brightening agent and a releasing agent.

2. The coating agent according to claim 1, wherein the amount of the alumina in the alumina dispersion is at most 60 weight %.

3. The coating agent according to claim 1, wherein aqueous dispersing medium is water, methanol, ethanol, n-propyl alcohol, isopropyl alcohol, acetone, methylethyl ketone, ethyl acetate glycols or mixture thereof.

4. The coating agent according to claim 1, wherein aqueous dispersing medium is a mixture of water and isopropyl alcohol, a mixture of water and methanol and/or ethanol, a nixture of water, ethylene glycol and isopropyl alcohol or a mixture of water, ethylene glycol, isopropyl alcohol and ethyl acetate.

5. The coating agent according to claim 1, wherein the alumina dispersion has an acidic range of pH 2 to pH 6.

6. The coating agent according to claim 1, wherein the amount of alumina dispersion is not less than 15 wt %.

7. The coating agent according to claim 1, wherein the amount of the alumina dispersion is from 15 to 50 wt %.

8. The coating agent according to claim 1, wherein the binder is an organic polymer selected from the group consisting of starch, modified starch, polyvinyl alcohol, modified polyvinyl alcohol, solvent soluble polyamide, hydroxycellulose, hydroxymethyl cellulose, carboxymethyl cellulose, and polyvinyl pyrrolidone.

9. The coating agent according to claim 8, wherein the organic polymer is said polyvinyl alcohol, said modified polyvinyl alcohol or said soluble polyamide.

10. The coating agent according to claim 9, wherein the organic polymer is a mixture of polyvinyl alcohol and polyvinyl acetal.

11. The coating agent according to claim 10, wherein the polyvinyl acetal has a molecular weight of $10\times10^4$ to $20\times10^4$ and a degree of acetallization of 0.3 to 10 mol %.

12. The coating agent according the claim 10, wherein the polyvinyl alcohol has a saponification value of 65 to 90 mol %.

13. The coating agent according to claim 10, comprising an alcoholic solvent selected from the group consisting of a lower aliphatic alcohol, glycol and an alcoholic mixture of a lower aliphatic alcohol with another solvent.

14. The coating agent according to claim 13, wherein the alcoholic mixture is a mixture of methanol and water.

15. The coating agent according to claim 1, further comprising at least one adjuvant selected from the group consisting of SBR latex and NBR latex.

16. The coating agent according to claim 1, wherein the amount of the binder relative to said alumina in terms of the solid weight ratio of alumnia/binder is 5/1 to 12/1.

17. An inkjet receptive coating agent capable of being coated onto a substrate to provide a recording medium for inkjet-printing, consisting of an alumina dispersion of alumina dispersed and aluminum nitrate dissolved in an aqueous dispersing medium, and a binder, wherein said alumina is δ-alumina or pseudboemite, wherein said alumina has an average primary particle size of 5 to 100 nm, wherein the amount of aluminum nitrate in the alumina dispersion is within the range of 0.1 to 10 parts by weight based on 100 parts by weight of said alumina, and wherein said aluminum nitrate is aluminum nitrate nonahydrate, and optionally further consisting of at least one of an acid, an alcoholic solvent, a leveling agent, a pH-regulating agent, a viscosity-regulating agent, an antifoaming agent, a defoaming agent, a dispersion-stabilizing agent, a brightening agent and a releasing agent.

18. An inkjet receptive coating agent capable of being coated onto a substrate to provide a recording medium for inkjet-printing, comprising an alumina dispersion containing alumina dispersed and aluminum nitrate dissolved in an aqueous dispersing medium, and a binder, wherein said alumina is δ-alumina or pseudboemite, wherein said alumina has an average primary particle size of 5 to 100 nm, wherein the amount of aluminum nitrate in the alumina dispersion is within the range of 0.1 to 10 parts by weight based on 100 parts by weight of said alumina, wherein said aluminum nitrate is aluminum nitrate nonahydrate, and wherein said coating agent is free of titania.

* * * * *